US007123854B1

(12) United States Patent
Cellura et al.

(10) Patent No.: US 7,123,854 B1
(45) Date of Patent: Oct. 17, 2006

(54) PRINTER CONTAMINANT ABATEMENT SYSTEMS AND METHODS

(75) Inventors: Mark A. Cellura, Webster, NY (US); Elliott Eklund, Penfield, NY (US); Scott J. Phillips, West Henrietta, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/125,431

(22) Filed: May 10, 2005

(51) Int. Cl.
*G03G 21/20* (2006.01)

(52) U.S. Cl. ..... 399/92; 399/93; 399/98; 399/99; 399/355

(58) Field of Classification Search ..... 399/98, 399/92, 124, 355, 343, 99, 93
See application file for complete search history.

(56) References Cited

U.S. PATENT DOCUMENTS 3,743,540 A * 7/1973 Hudson ..... 134/1
5,066,983 A 11/1991 Tonomoto
5,081,496 A 1/1992 Takeda
5,978,631 A * 11/1999 Lee ..... 399/251
6,411,788 B1 * 6/2002 Ogasawara ..... 399/92
6,453,147 B1 * 9/2002 Morse et al. ..... 399/353
2003/0052545 A1 3/2003 Jung
2003/0170043 A1 9/2003 Rejewski et al.
2004/0037582 A1 * 2/2004 Shin ..... 399/93

* cited by examiner

*Primary Examiner*—David M. Gray
*Assistant Examiner*—Bryan Ready
(74) *Attorney, Agent, or Firm*—Gibb I.P. Law Firm, LLC

(57) ABSTRACT

Embodiments herein comprise a compact dust abatement apparatus that includes at least one manifold shaped to fit next to a belt or drum of a printing engine, at least one blower/fan positioned within the manifold, and at least one air duct connected to the manifold. The manifold has a vacuum opening adjacent the belt or drum and an exit opening where the air duct connects to the manifold. The blower is positioned inside the manifold, between the vacuum opening and the exit opening, such that the blower draws air and particles from the vacuum opening toward the exit opening. Thus, the blower creates a vacuum at the vacuum opening. The air duct directs air and particles from the manifold to a location away from the sensitive components. The inclusion of the blower inside the vacuum manifold provides for compactness without sacrificing performance.

13 Claims, 5 Drawing Sheets

FIG. 1
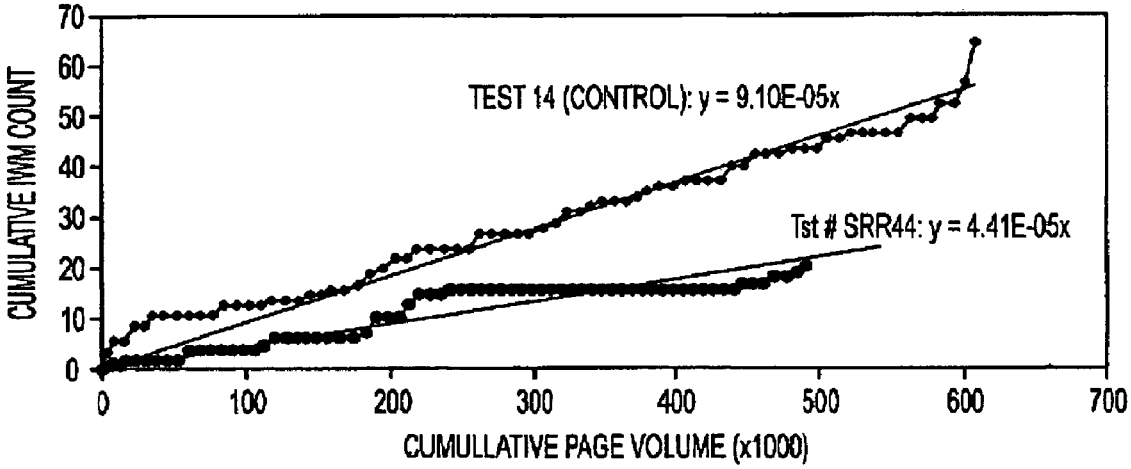
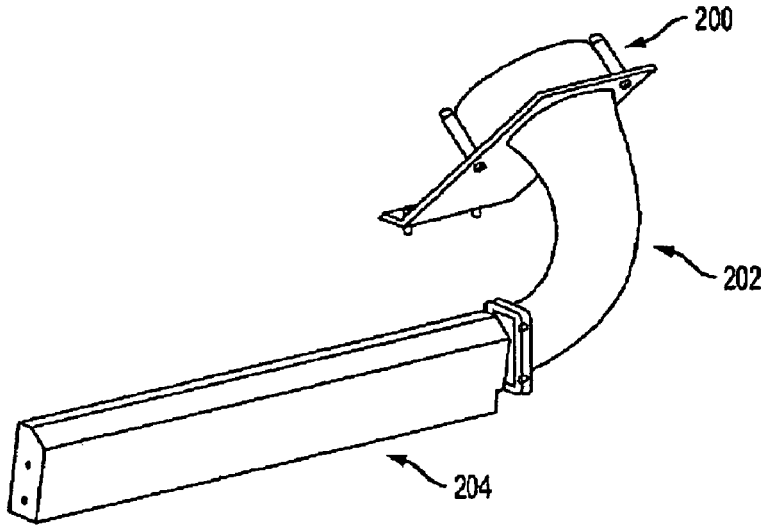
FIG. 2
PRIOR ART

FIG. 3
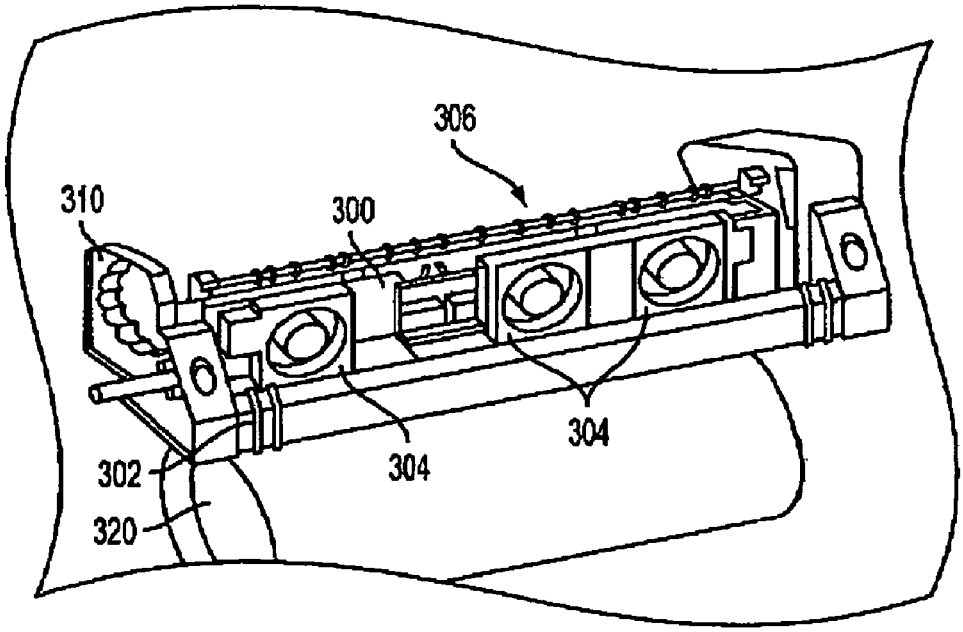
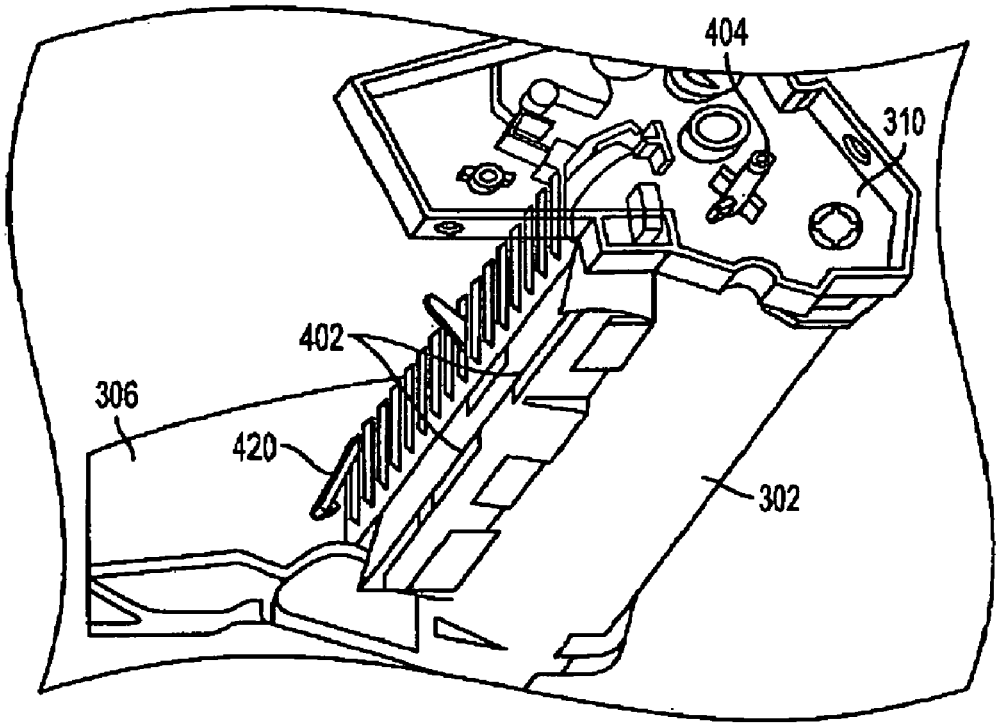
FIG. 4

PRINTER CONTAMINANT ABATEMENT SYSTEMS AND METHODS

BACKGROUND

Vacuum abatement systems, which prevent contaminants from reaching critical printer components, typically consist of a manifold or nozzle, a vacuum source (e.g. blower or fan) and ducting to connect the vacuum source and the manifold. Physically separating the manifold and blower allows the manifold to be embedded in the architecture, closely spaced from the surfaces or elements being cleaned, with the blower located in some less space-restricted area. The drawback is the creation of additional resistance to abatement airflow by the connecting duct, which is often long and can have many bends. In addition to degrading the airflow in the abatement system, the ducting adds complexity and cost. The ducting itself may consist of several components, and connections and seals are needed on both the blower and manifold ends of the duct.

As also discussed in U.S. Patent Publication 2003/0170043 (incorporated herein by reference) dust, debris, and toner may adversely affect the development operation in image-forming machines. Dust from each development station may adversely affect the development process in the other development stations. If similarly charged, the airborne toner from one development station may adhere to the photoconductor in place of the toner from another development station. The blending of toner from different development stations also adversely affects the toner properties and subsequently the image quality. If oppositely charged, the airborne toner may blend with the toner from the other development station and may then be attracted to the non-image areas producing a background or fog in the image.

Some image-forming machines implement one or more approaches to remove or otherwise control the airborne toner and carrier. See, for example, U.S. Patent Publication 2003/0052545, and U.S. Pat. Nos. 5,081,496, and 5,066,983 (all incorporated herein by reference) which utilize an external fan connected to a tube to create a vacuum near the cartridge or drum. A vacuum pump, fan, or other air movement device may be used to remove and filter the airborne toner from the air within the image-forming machine. Smaller vacuum pumps may be used to remove toner stacks or other build-up of toner in the image-forming machine. Some image-forming machines have a vacuum or electrostatic tube with several openings for applying a vacuum or an electrostatic charge along the trailing edge of the development station. These trailing edge openings collect airborne toner and carrier exiting along the trailing edge.

SUMMARY

Embodiments herein comprise a compact dust abatement apparatus that includes at least one manifold shaped to fit next to a belt or drum of a printing engine, at least one blower positioned within the manifold, and at least one air duct connected to the manifold. The manifold has a vacuum opening adjacent the belt or drum and an exit opening where the air duct connects to the manifold. The blower is positioned inside the vacuum manifold, between the vacuum opening and the exit opening, such that the blower draws air and particles from the vacuum opening toward the exit opening. Thus, the blower creates a vacuum at the vacuum opening. The air duct directs air and particles from the manifold to a location away from the image drum or belt, or other sensitive component.

The manifold can comprise an integrated portion of a paper exit module assembly of the printing engine or can be connected to the paper exit module assembly. The paper exit module assembly includes paper guides that guide paper toward the exit of the apparatus or printer. In another embodiment, the manifold has a size and shape to fit within a paper exit module assembly of the printing engine.

The manifold has a size and shape to match the belt or drum and the manifold is quite compact. Thus, the manifold can be used with existing systems without significant modification. Indeed, when the manifold is included within, or as part of the paper exit module, it is about the same size as conventional paper exit modules.

These and other features are described in, or are apparent from, the following detailed description.

BRIEF DESCRIPTION OF THE DRAWINGS

Various exemplary embodiments of the systems and methods described in detail below, with reference to the attached drawing figures, in which:

FIG. 1 is a graph showing rates of recoverable failures; and

FIGS. 2–7 are schematic representations of dust abatement systems.

DETAILED DESCRIPTION

Figure 5:
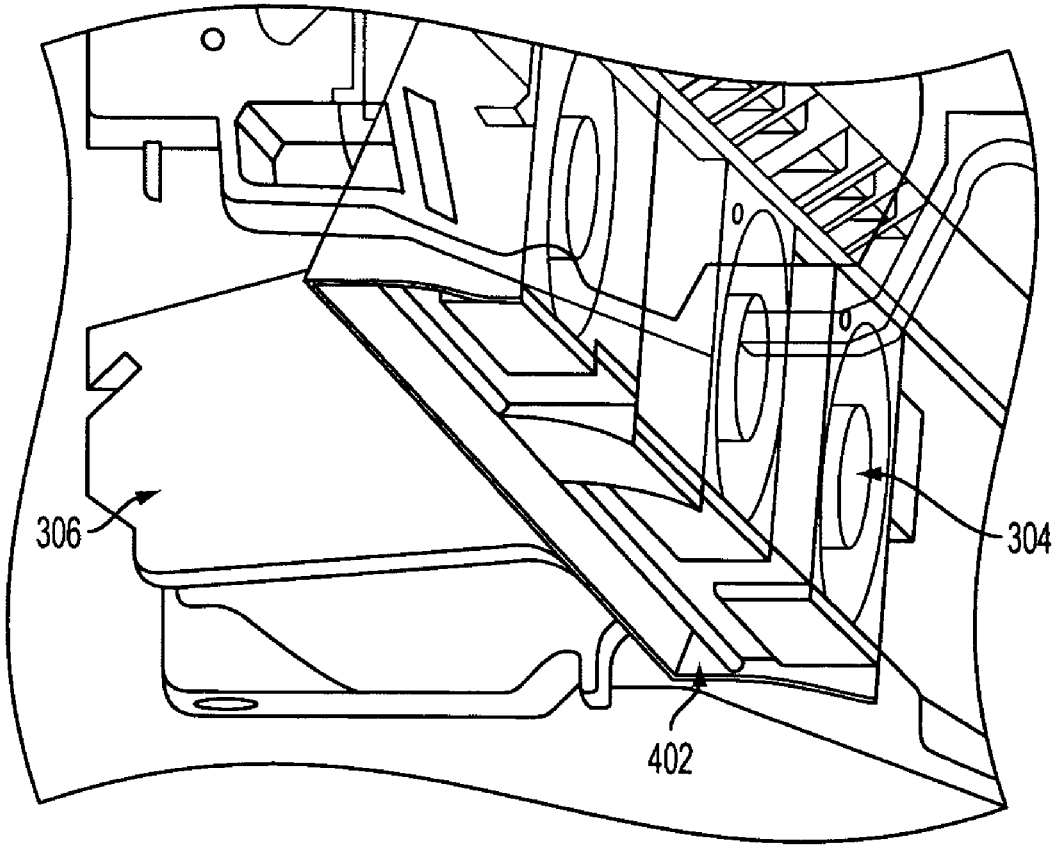

Embodiments herein comprise a vacuum-based abatement system which incorporates the source of airflow (e.g., blowers/fans) inside the vacuum manifold itself. In this case, the manifold serves multiple purposes: it provides the nozzle opening through which the cleaning takes place, it provides the cavity that holds the vacuum airflow source(s) in which the vacuum is generated, and it provides an exhaust opening through which the particle-laden air can pass to the outside of the printer, or to some suitable container which collects contaminants. The embodiment eliminates many of the interfaces of a vacuum abatement system with ducting to connect the vacuum source and manifold, thereby increasing compactness, and reducing cost and complexity. Such compact abatement systems are generally desirable, particularly for smaller printers.

Embodiments herein comprise a vacuum manifold with internal fans to generate the airflow needed for contamination abatement. In solid ink printers, the image drum bears the image printed by the print head, and subsequently transfers this image to paper via the transfix operation. The image drum surface has been identified as a carrier of paper fibers and particulates to the print head. Cleaning of the intermediate image drum with vacuum abatement has been shown to reduce the number of print head failures. Many print head failures (intermittent weak or missing jets) are recoverable by performing a print head maintenance cycle, which, among other things, cleans dirt and stray ink from the print head aperture plate. Chronic weak or missing jets are permanent, and are often the result of contamination clogging one or more of the jetting apertures. Vacuum abatement is effective in reducing the rate of deposition of contaminants on the print head, thereby increasing print head reliability by reducing recoverable and permanent contamination-related failures.

Print testing with solid ink printers has demonstrated the benefit of vacuum abatement in reducing the number of intermittent weak or missing jets (IWMs). FIG. 1 below shows the rates of recoverable failures (IWMs) in printers with and without abatement. The values shown in FIG. 1 are similar to those that are achieved by embodiments herein, although FIG. 1 is not intended to demonstrate the performance of any specific embodiment herein. Instead, FIG. 1 is utilized to generally demonstrate the benefit of contaminants abatement systems. Those printers with abatement have a failure rate which is approximately 50% lower than printers with no abatement.

FIG. 2 shows one vacuum abatement design, which uses a tapered duct 202 to connect the remotely mounted blower 200 and vacuum manifold 204. The abatement systems in these printers used manifolds 204 supplied with airflow from external blowers 200 as shown in FIG. 2. Ducting 202 connects the blower 200 to the vacuum manifold 204. While this is acceptable for testing purposes, it is difficult to implement in products, particularly desktop printers, due to space limitations. The ducting 202 is also a source of airflow resistance, which reduces abatement effectiveness. Even in larger printers where ducting is justified, there is added complexity and cost associated with the duct 202 itself, and with the connections needed on both the manifold and blower sides.

An embodiment 300 is shown in cut-away view in FIG. 3. This particular design is intended for a solid ink printer, although it can be used with any type of printing engine. This vacuum manifold 302 contains three small muffin fan blowers 304, or any other device that moves air (herein referred to generally as "blower") mounted internally, to generate the airflow needed to remove paper fibers and dust from the image drum 320 surface and surroundings. The vacuum manifold 302 is integral with the paper exit module assembly 310. In the embodiment shown in FIG. 3, the fans 304 are exposed to the outside of the vacuum manifold 302 which causes any debris that is drawn into the vacuum manifold 302 to directly exit the exposed portions of the fans 304. Therefore, this embodiment is designed to work without any duct work such as item 202, showing FIG. 2. This embodiment is designed to be positioned directly next to an external opening, filter, etc. so that the debris exiting from the exposed portions of the fans 304 will not return to the image drum 320.

Embodiments herein allow the manifold to simultaneously serve as the nozzle through which contaminants are cleaned from the image drum, provide the enclosure in which the vacuum source is contained, and facilitate the exit of the abatement air stream, which is exhausted directly to the exterior of the printer, away from critical internal components (i.e., the print head), such as image bearing members of the printing engine. As used herein, and image bearing member can comprise any item within a printing engine which suffers substantial performance degradation if not kept free of debris and contaminants. Therefore, the image bearing members herein can comprise drums, belts, printheads, photoreceptors, etc.

Due to its compactness, the entire abatement system can be mounted above the image drum, in or as part of the paper exit module assembly 310. Also, even with its internally mounted fans, the design shown here is projected to cost significantly less than the conventional abatement systems, while still providing adequate airflow and pressure drop (approximately 7–8 cubic feet/min @–0.01 inches of water, for example). FIG. 1 shows the reliability benefit attained with vacuum abatement using a manifold with a remotely mounted blower, operating with the pressure and flow conditions previously mentioned. The compact design, if operated with similar pressure and air flow conditions, is expected to give a similar performance benefit. FIG. 4 shows a bottom view of embodiments herein, where the vacuum slit (orifice) 402 can be seen. In this design, the contaminant-laden air stream from the abatement system is exhausted directly to the exterior of the printer. FIG. 4 also illustrates the paper exit guides 420 and the mounting points 404 of the paper exit module assembly 310 and the vacuum manifold 302. Again, the vacuum manifold 302 can be an integral part of the paper exit module assembly 310 or can be a separate piece connected to the paper exit module assembly 310. FIG. 5 shows a close-up of the bottom of the abatement manifold, again in cut-away view.

Figure 6:
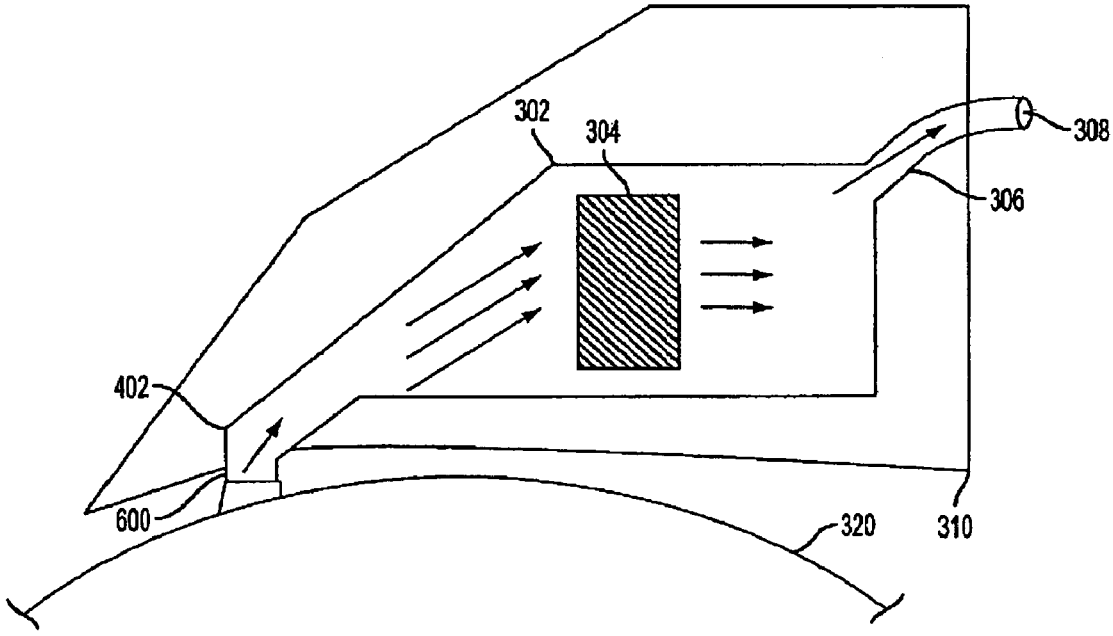

FIGS. 5 and 6 are cross-sectional schematic diagrams of paper exit module assemblies 310 positioned next to a surface that is to be cleaned, such as the drum 320 or other sensitive components including, but not limited to heads, photoreceptor, belt, roller, paper guide, sensor, etc. The vacuum manifold 302 is shown as a separate item within the paper exit module assembly 310; however, the vacuum manifold 302 does not need to utilize separate chamber walls, but instead can form a vacuum within the walls of the paper exit module assembly 310 (as illustrated in the embodiment is shown in FIGS. 3–5). FIGS. 3–5 and 7 illustrate structures where the vacuum is formed within the walls of the paper exit module assembly 310, while FIG. 6 illustrates a different embodiment that includes a separate vacuum manifold 302 within the paper exit module assembly 310. In the embodiment shown in FIG. 6, the vacuum manifold 302 includes a contaminate exit module assembly 306 connected to duct work 308. As with the structure shown in FIG. 2, the duct work 308 should be sent to an area external to the printer, through, for example a filter, etc. so that the contaminants do not return to the drum 320. All embodiments within FIGS. 3–7 place one or more fans 304 between the vacuum orifice 402 and the paper exit module assembly 310. The fans 304 force air movement to draw air from the vacuum orifice 402 toward the contaminant exit module assembly 306 as shown by the arrows in FIG. 6 in order to create a vacuum at the vacuum orifice 402.

Figure 7:
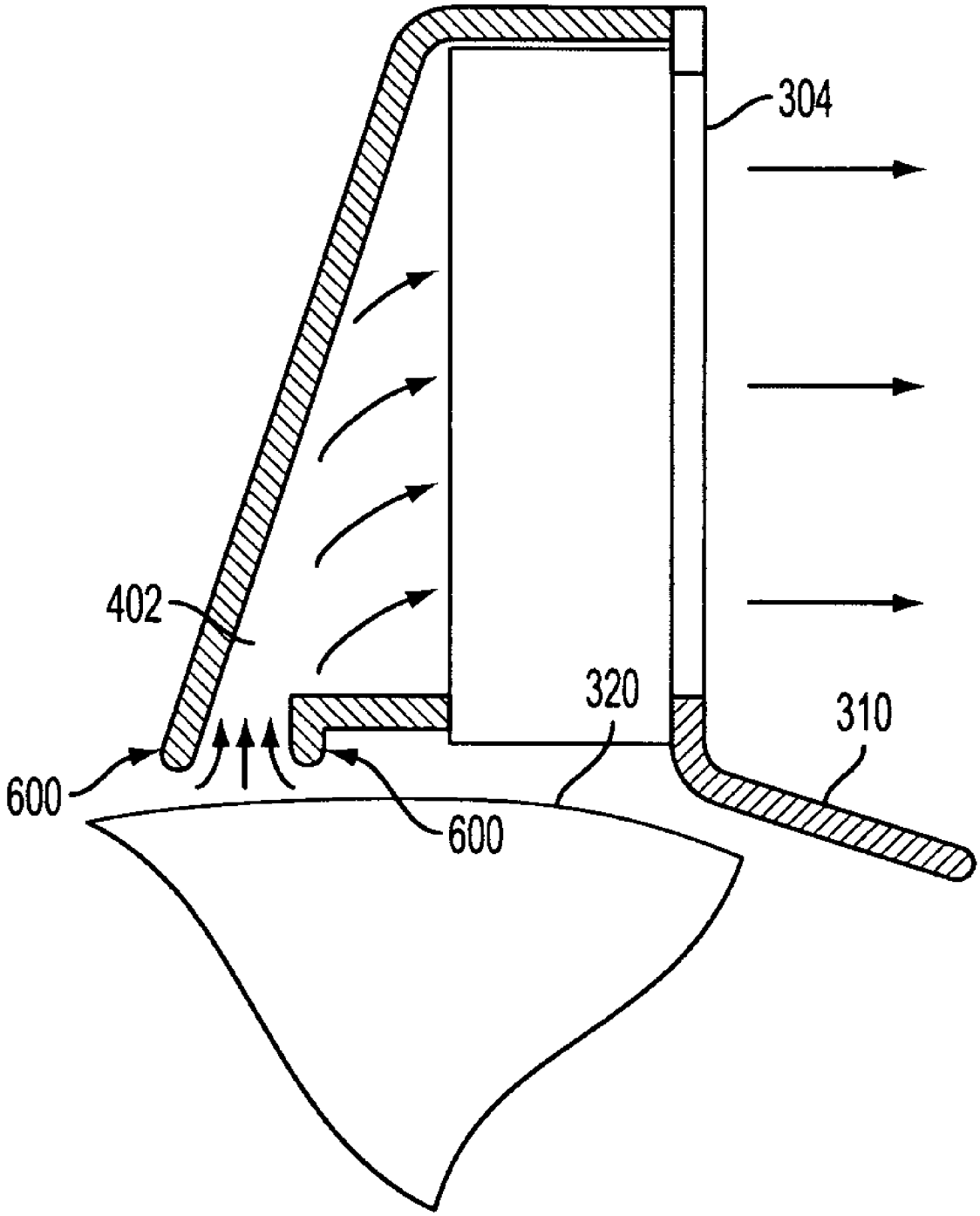

FIGS. 6 and 7 also illustrate optional ribs 600 or lips that can be attached or formed on the edges of the vacuum orifice 402 to increase the application of the vacuum to the drum/belt 320 or surface that is to be cleaned. These ribs 600 can be rigid or compliant allowing them to be placed very close to the drum 320, thereby applying a strong vacuum force to the drum 320 without risking damage or scratching of the drum 320.

One of the features illustrated in the embodiments shown in FIGS. 3–7 is that by positioning the fan(s) internally within the paper exit module assembly 310 (or within a separate vacuum manifold assembly 302), the size of the paper exit module assembly can potentially be allowed to remain the same and not increase in size, or may increase in size only slightly. Further, because the fan(s) is so close to the vacuum orifice 402 (when compared to the external fan structure shown in FIG. 2) it exerts a stronger vacuum force because the vacuum force does not need to travel through extensive ducting.

It has been estimated that during the warranty period, the financial benefits of this type of abatement for solid ink will exceed the cost of the system. Additional calculations of the post-warranty financials indicate that the added reliability due to vacuum abatement will show up as a significant benefit to the customer, both in terms of extending the service life of the print head (saving the customer the cost of head replacement) and in reducing annoying customer interventions to recover intermittent jets. This has the potential for increasing the likelihood of repeat purchase of future products and of positive recommendations to other potential customers.

While the data and implementations shown above are for solid ink printing with an intermediate image drum architecture, vacuum abatement has general application to a wide variety of printing architectures, including xerographic and direct-to-paper ink jet printing. Embodiments herein described herein are suitable for and would give benefits to a wide variety of printing technologies, particularly those in which a compact, duct-less design is a requirement.

Thus, embodiments herein comprise a compact dust abatement apparatus that includes at least one manifold shaped to fit next to a belt or drum of a printing engine, at least one blower/fan positioned within the manifold, and at least one air duct connected to the manifold. The manifold has a vacuum opening adjacent the belt or drum and an exit opening where the air duct connects to the manifold. The blower is positioned between the vacuum opening and the exit opening, such that the blower draws air and particles from the vacuum opening toward the exit opening. Thus, the blower creates a vacuum at the vacuum opening. The air duct directs air and particles from the manifold to a location away from sensitive components.

The manifold can comprise an integrated portion of a paper exit module assembly of the printing engine or can be connected to the paper exit module assembly. In another embodiment, the manifold has a size and shape to fit within a paper exit module assembly of the printing engine. The manifold has a size and shape to match the belt or drum and the manifold is quite compact. Thus, the manifold can be used with existing systems without significant modification. Indeed, when the manifold is included within, or as part of the paper exit module, it is about the same size of conventional paper exit modules.

It will be appreciated that varieties of the above-disclosed features and functions, or alternatives thereof, may be desirably combined into many other different systems or applications. Also various presently unforeseen or unanticipated alternatives, modifications, variations or improvements therein may be subsequently made by those skilled in the art which are also intended to be encompassed by the following claims.

What is claimed is:

1. An apparatus comprising:

at least one manifold shaped to fit next to an image bearing member of a printing engine, wherein said manifold comprises a vacuum opening adjacent said image bearing member and paper guides;

at least one blower positioned within said manifold; and at least one air duct connected to said manifold and positioned outside said manifold, wherein said air duct is positioned to direct air and particles from said manifold to a location away from said manifold, wherein said manifold comprises an exit opening where said air duct connects to said manifold, and wherein said blower is positioned between said vacuum opening and said exit opening, such that said blower blows air and particles only from said vacuum opening toward said exit opening and into said air duct.

2. The apparatus according to claim 1, wherein said blower is adapted to create a vacuum at said vacuum opening.

3. The apparatus according to claim 1, wherein said air duct is not connected to an external blower outside said manifold.

4. An apparatus comprising:

at least one manifold shaped to fit next to an image bearing member of a printing engine within said apparatus, wherein said manifold comprises paper guides and a vacuum opening adjacent said image bearing member and an exit opening; and at least one blower positioned within said manifold such that said blower blows air and particles only from said vacuum opening directly to said exit opening and away from said image bearing member.

5. The apparatus according to claim 4, wherein said manifold is not connected to any duct work such that said air and particles exit said manifold directly at said exit opening.

6. The apparatus according to claim 4, wherein manifold is positioned within said apparatus and said exit opening is exposed to an exterior of said apparatus such that said blower blows air and particles only from said vacuum opening to said exterior of said apparatus through said exit opening.

7. The apparatus according to claim 4, wherein said blower is adapted to create a vacuum within said manifold at said vacuum opening.

8. The apparatus according to claim 4, wherein said manifold has a size and shape to match said image bearing member.

9. An apparatus comprising:

at least one manifold shaped to fit next to an image bearing member of a printing engine within said apparatus, wherein said manifold comprises paper guides and a vacuum opening adjacent said image bearing member; and at least one blower positioned within said manifold, wherein a first side of said blower is exposed to an exterior of said manifold such that said blower blows air and particles only from said vacuum opening directly to said exterior of said manifold and away from said image bearing member.

10. The apparatus according to claim 9, wherein said manifold is not connected to any duct work such that said air and particles exit said manifold directly at said first side of said blower.

11. The apparatus according to claim 9, wherein manifold is positioned within said apparatus and said first side of said blower is exposed to an exterior of said apparatus such that said blower blows air and particles only from said vacuum opening to said exterior of said apparatus.

12. The apparatus according to claim 9, wherein said blower is adapted to create a vacuum within said manifold at said vacuum opening.

13. The apparatus according to claim 9, wherein said manifold has a size and shape to match said image bearing member.

* * * * *